US006994193B2

(12) United States Patent
Saetia

(10) Patent No.: US 6,994,193 B2
(45) Date of Patent: Feb. 7, 2006

(54) CASE WITH REMOVABLE HANDLE AND WHEEL ASSEMBLY

(75) Inventor: Chettha Saetia, 1850 W. Grand Ave., Chicago, IL (US) 60622

(73) Assignee: Chettha Saetia, Lake Villa, IL (US)

( * ) Notice: Subject to any disclaimer, the term of this patent is extended or adjusted under 35 U.S.C. 154(b) by 0 days.

(21) Appl. No.: 10/609,970

(22) Filed: Jun. 30, 2003

(65) Prior Publication Data

US 2004/0011617 A1 Jan. 22, 2004

Related U.S. Application Data

(63) Continuation of application No. 10/044,456, filed on Jan. 10, 2002, now Pat. No. 6,595,334.

(51) Int. Cl.
*A45C 5/14* (2006.01)

(52) U.S. Cl. ..... 190/18 A; 190/102; 190/115; 190/903; 224/153; 280/37; 280/655

(58) Field of Classification Search ..... 190/18 A, 190/1, 108, 115, 116, 18 R; 280/DIG. 3, 280/655, 47.17, 37; 16/113.1; 224/153
See application file for complete search history.

(56) References Cited

U.S. PATENT DOCUMENTS

| | | | | | |
|---|---|---|---|---|---|
| 480,709 | A | * | 8/1892 | Capitain | 190/37 |
| 1,081,670 | A | * | 12/1913 | James | 280/30 |
| 1,099,933 | A | * | 6/1914 | Pohrer | 280/47.17 |
| 1,757,490 | A | * | 5/1930 | Tibbetts | 410/51 |
| 2,992,011 | A | * | 7/1961 | Becan | 280/654 |
| 3,163,268 | A | * | 12/1964 | Leavell | 190/18 A |
| 3,693,994 | A | * | 9/1972 | Wilson | 280/651 |
| 3,861,703 | A | * | 1/1975 | Gould | 280/47.131 |
| 3,934,895 | A | * | 1/1976 | Fox | 280/47.26 |
| 4,029,327 | A | * | 6/1977 | Kolstein | 280/47.131 |
| 4,122,925 | A | * | 10/1978 | Schultheiss | 190/108 |
| 4,593,841 | A | * | 6/1986 | Lange | 224/153 |
| 4,596,397 | A | * | 6/1986 | Conti | 280/47.131 |
| 4,979,598 | A | * | 12/1990 | Verheij et al. | 190/18 A |
| 5,277,449 | A | * | 1/1994 | Schmidt | 280/655 |
| 5,323,886 | A | * | 6/1994 | Chen | 190/18 A |
| 5,375,685 | A | * | 12/1994 | Plath | 190/18 A |
| 5,447,261 | A | * | 9/1995 | Mitomi et al. | 224/153 |
| 5,524,737 | A | * | 6/1996 | Wang | 190/18 A |
| 5,529,322 | A | * | 6/1996 | Barton | 280/30 |
| 5,749,446 | A | * | 5/1998 | Hsieh | 190/107 |
| 5,951,037 | A | * | 9/1999 | Hsieh et al. | 280/655 |
| 5,971,119 | A | * | 10/1999 | Chi | 190/108 |
| 6,042,127 | A | * | 3/2000 | Rupolo | 280/33.998 |

(Continued)

FOREIGN PATENT DOCUMENTS

DE 43 00 327 A1 7/1994

(Continued)

*Primary Examiner*—Sue A. Weaver
(74) *Attorney, Agent, or Firm*—Patti & Brill, LLC

(57) ABSTRACT

A luggage case is provided with straps or handles for carrying the case and a wheel and an extendable handle assembly for dragging or pulling the case. The wheel and extendable handle assembly is removably attachable to the case, such that it need not be carried when the case is carried by the straps or handles. The wheel and handle assembly are formed as a shell to snugly surround the luggage case. In the preferred embodiment, the case and the shell are joined by mating zippers at the bottom front and top rear edges of the assembly.

102 Claims, 10 Drawing Sheets

U.S. PATENT DOCUMENTS

| | | | | |
|---|---|---|---|---|
| 6,070,888 | A | 6/2000 | Wang | |
| 6,082,757 | A * | 7/2000 | Lin | 280/654 |
| 6,213,267 | B1 * | 4/2001 | Miller | 190/108 |
| 6,260,680 | B1 * | 7/2001 | Lin | 190/119 |
| 6,460,668 | B1 * | 10/2002 | Godshaw et al. | 190/18 A |
| 6,595,334 | B1 * | 7/2003 | Saetia | 490/18 A |
| 2003/0184034 | A1 | 10/2003 | Pfeiffer | |

FOREIGN PATENT DOCUMENTS

| | | | | |
|---|---|---|---|---|
| DE | 297 13 078 | U1 | 10/1997 | |
| DE | 198 55 728 | A1 | 6/2000 | |
| EP | 0191885 | A1 * | 8/1986 | 190/18 A |
| FR | 2641172 | A1 * | 7/1990 | |
| GB | 2 053 102 | A | 2/1981 | |

* cited by examiner

CASE WITH REMOVABLE HANDLE AND WHEEL ASSEMBLY

This is a continuation of Application No. 10/044,456, filed Jan. 10, 2002, now U.S. Pat. No. 6,595,334.

FIELD OF THE INVENTION

The present invention relates to luggage, and more particularly to small luggage cases, such as business cases, computer cases, backpacks and the like which may be provided with shoulder straps or hand grips for carrying, or with wheels for rolling on a surface and an extendable handle for pulling by a user.

BACKGROUND OF THE INVENTION

In the past, most items of luggage, such as those used for overnight travel, were formed of stiff or rigid material as rigid enclosures. Similarly, items of luggage used to carry papers, personal items and other materials to be kept close at hand, particularly when using public transportation, such as airplane or trains, typically referred to as briefcases, where also either made of stiff or rigid material as rigid enclosures, or of rather stiff material such as leather with some flexible portions to permit expansion and contraction. More recently, both types of luggage mentioned above have been formed as relatively unstructured enclosures made of non-rigid natural or man-made materials such as leather, canvas or nylon. The non-rigid material forming the enclosure is assembled to provide luggage of a particular shape. In some cases, a rigid framework is provided to maintain the desired shape of the luggage.

A further development in luggage industry has been the use of wheeled luggage for checked baggage, carry-on baggage and some business cases. For the purposes of this discussion, the term "business case" may include cases designed to hold and transport portable computers. Luggage of this type typically includes wheels and an extendable handle, so that the user can pull the case along on its wheels, without having to bear its full weight. Additional items may be supported by the handle assembly or attached to the case itself, to ease the burden of the user when moving through airport concourses or along city sidewalks. Examples of such additional items are garment bags and other business cases.

The most commonly available luggage of this type has wheels and extendable handle permanently attached to the luggage. When luggage of this type is not being transported on its wheels, the extendable is retracted. When this arrangement is included as part of the design of a business case, the bulk and weight of the case, with its integrated wheel and handle assembly, is are often cumbersome and uncomfortable to carry.

For instance, the same case may be used during business trips and while commuting between home and office. On a business trip the integrated handle and wheel assembly is a blessing; on a commuter train, the bulk and weight of the assembly may be a curse. When such a business case or backpack is carried by shoulder straps or handles, the typically unpadded structure of the retracted handle and wheel assembly can irritate the user's rib cage.

Accordingly, it would be advantageous to provide a luggage system consisting of a case and a wheel and handle assembly which may be readily secured to the case when needed and removed when not needed. Further, it would be desirable to provide the readily removable wheel and handle assembly and the case with complementary devices for securing them to each other. It would be further desirable that the removable wheel and handle assembly and the case be of complementary design, so as to be of pleasing appearance when secured to each other. Finally, it would be desirable that the wheel and handle assembly provide extra strength to the case, particularly when it is fully packed and heavy.

SUMMARY OF THE INVENTION

It is an object of this invention to provide a luggage system which includes a case provided with straps or handles for carrying the case and a wheel and extendable handle assembly for dragging the case. It is a further object of this invention to provide a wheel and extendable handle assembly which may be removably attached to the case.

It is another object of this invention to provide a case with a removable wheel and extendable handle assembly which are attached to each other by complementary fasteners provided on the case and the removable wheel and extendable handle assembly.

It is a still further object of this invention to provide a removable wheel and extendable handle assembly which provides additional protection and rigidity to the case when attached to the case for dragging of the case.

A case with removable wheel and extendable handle assembly in accordance with this invention includes a soft sided case having one or more main storage volumes made accessible by openings which may be held closed by fastening devices. The case may also have additional storage areas for as pockets on the sides of the walls of the main storage areas. Handles are secured to the walls of the main storage area for a person to grasp while carrying the case. In of the preferred embodiments of this invention, straps are secured to the walls of the main storage area which may be used to carry to case as a back pack. A removable wheel and extendable handle assembly in accordance with this invention includes a partial housing having a base, sides and a back. A pair of wheels are mounted on the partial housing adjacent the corners formed by the base, sides and back. The back is provided with an arrangement for telescopically receiving an extendable handle assembly. In a preferred embodiment of this invention, the back of the partial housing is of essentially the same height as the case, the base is of essentially the same width and depth as the case, and the sides are of reduced height as compared to the back. Complimentary fastening devices are provided on the removable wheel and extendable handle assembly and on the case, the removable secure the assembly to the case. In a preferred embodiment of this invention, the complimentary fastening devices are in the form of zippers, similar to those used to provide access to the main storage volume and the auxiliary storage volumes. More particularly, one portion of a zipper is secured around the edge of the back of the partial housing, while the other portion of the zipper is provided on the case, such that when the case is place in the partial housing, the zipper portions may be secured to each other in the usual manner. Similarly, one portion of a zipper may be provided on the edge of the bottom opposite the back, and the other portion on the case, such that when the case is placed in the partial housing, the zipper portions may be secured to each other in the usual manner.

DETAILED DESCRIPTION OF THE PREFERRED EMBODIMENT

Figure 1:
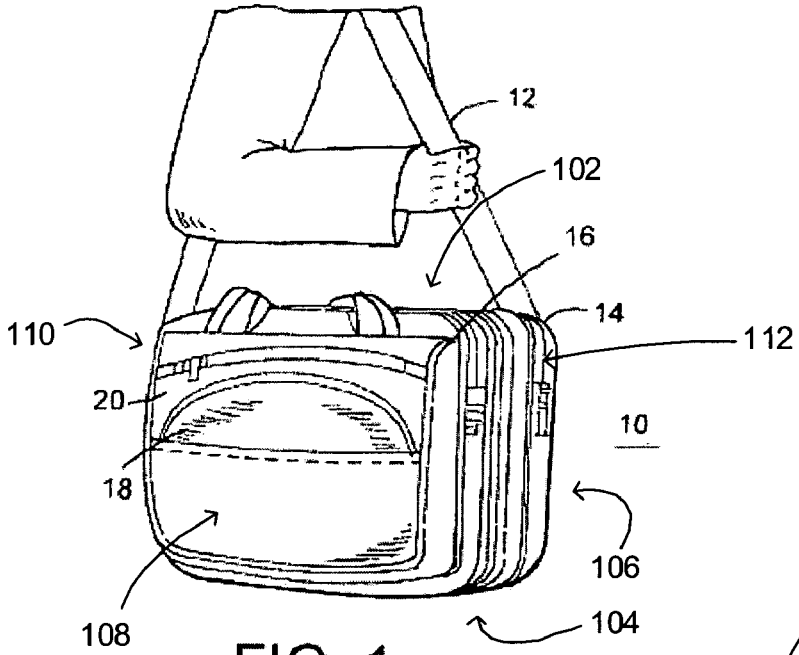
FIG. 1 is a general perspective view of a business case in accordance with the preferred embodiment of this invention transported as a brief case.

Referring to FIG. 1, a case 10 in one example comprises a business case 10 and/or a luggage case 10. The business case 10 in accordance with a preferred embodiment of this invention is provided with a shoulder strap 12 so as to be carried by the user. Business case 10 is generally of a rectangular shape, with access being provided to three main storage compartments by zippers 14 and 16. Auxiliary storage compartments 18 and 20 are provided on one side of the case 10.

The luggage case 10 in one example comprises a small luggage case 10. The small luggage case 10 in one example comprises top 102, bottom 104, face 106, face 108, side 110, and side 112. From one user perspective the face 106 comprises a front of the small luggage case 10 and from another user perspective the face 108 comprises the front of the small luggage case 10.

The small luggage case 10 comprises a first dimension, for example, a height, between the top 102 and the bottom 104. The small luggage case 10 comprises a second dimension, for example, a width, between the side 110 and the side 112.

Figure 2:
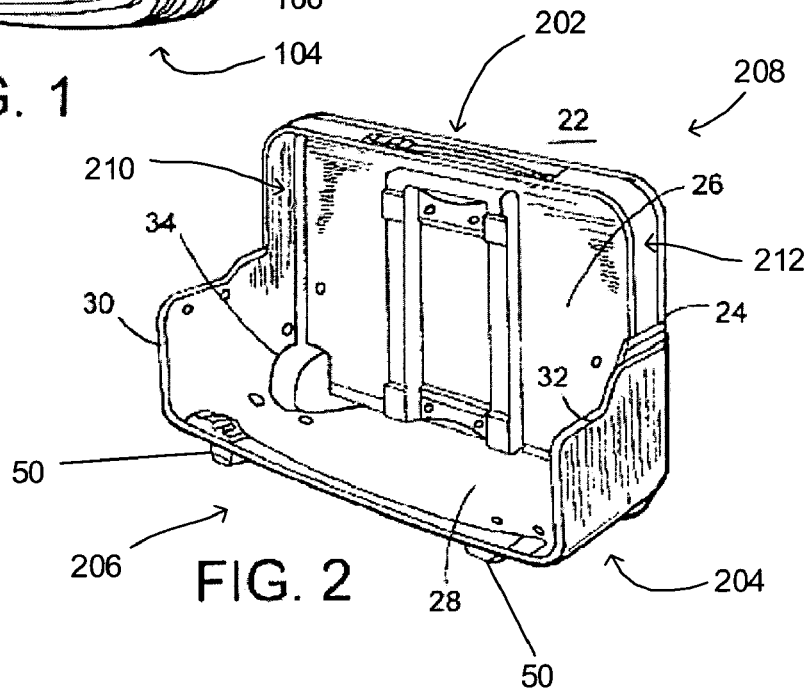
FIG. 2 is a perspective view of a removable wheel and extendable handle assembly in accordance with this invention for use with the case shown in FIG. 1.
Figure 8:
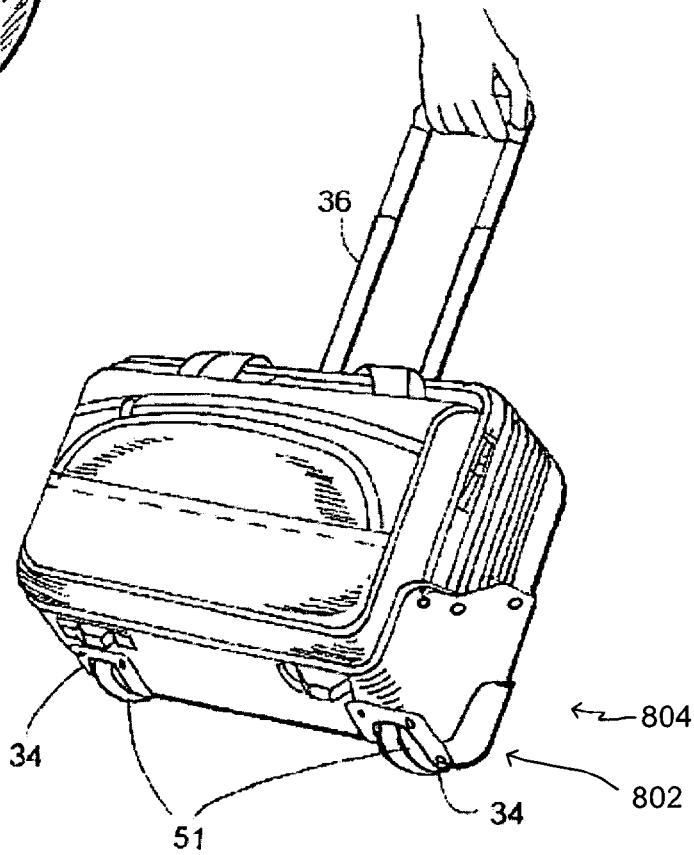
FIG. 8 is a perspective view showing the case of FIG. 1 secured in the removable wheel and extendable handle assembly of FIG. 2, with the extendable handle extended and being used to pull the case.

Referring to FIG. 2, wheel and handle assembly 22 in accordance with this invention is shown to include a partial housing shell 24. Shell 24 includes back 26, base 28 and side members 30 and 32. Wheel housings 34 are formed in the rear base of shell 24. Wheels 51 are rotatably mounted within wheel housings 34 as shown in FIG. 8. Telescoping extendable handle 36 is slidably mounted to the interior of shell back 26 by upper bracket 38 and lower bracket 40. Shell back 26 includes surround gusset 42 which extends around the upper perimeter of shell back 26 to form a flexible top and upper sides of shell 24. Access zipper 44 is provided in surround gusset 42 to provide access, when open, for handle 36, and through which handle 36 is extended.

Upper zipper half 46 is stitched to the leading edge of surround gusset 42. Lower zipper half 48 is stitched to the leading edge of shell base 28. Support feet 50 are provided on the bottom of base 28.

Figure 6:
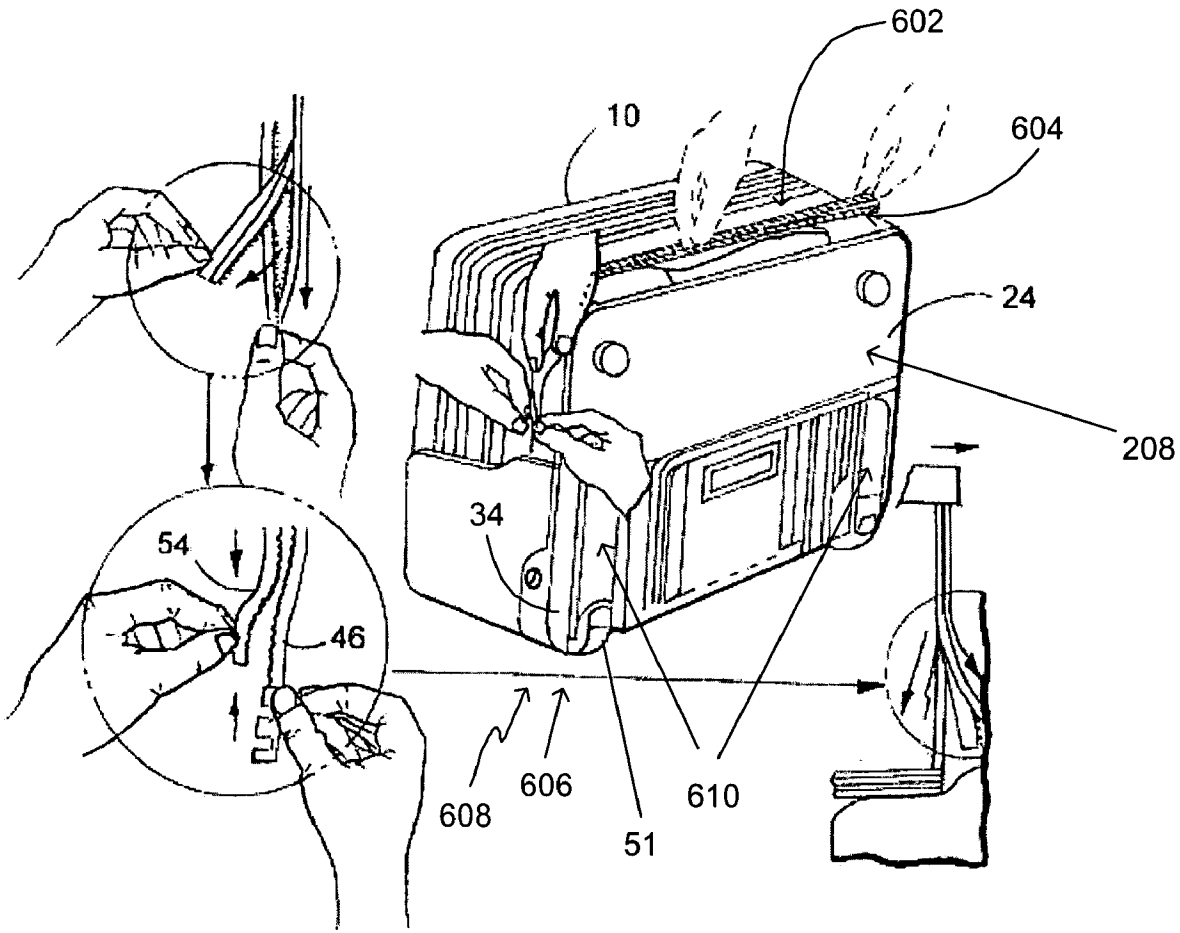
FIG. 6 is a rear perspective view showing the case of FIG. 1 placed in the removable wheel and extendable handle assembly of FIG. 2, and a series of detail figures illustrating the attachment process at the top and sides of the combined assembly.

Referring to FIGS. 2 and 6, the wheel and handle assembly 22 in one example comprises the shell 24, the wheel housings 34, top 202, bottom 204, face 206, face 208, side 210, side 212, and skid plates 610. From one user perspective the face 206 comprises a front of the wheel and handle assembly 22 and from another user perspective the face 208 comprises the front of the wheel and handle assembly 22.

The wheel and handle assembly 22 comprises a first dimension, for example, a height, between the top 202 and the bottom 204. The wheel and handle assembly 22 comprises a second dimension, for example, a width, between the side 210 and the side 212.

Figure 5:
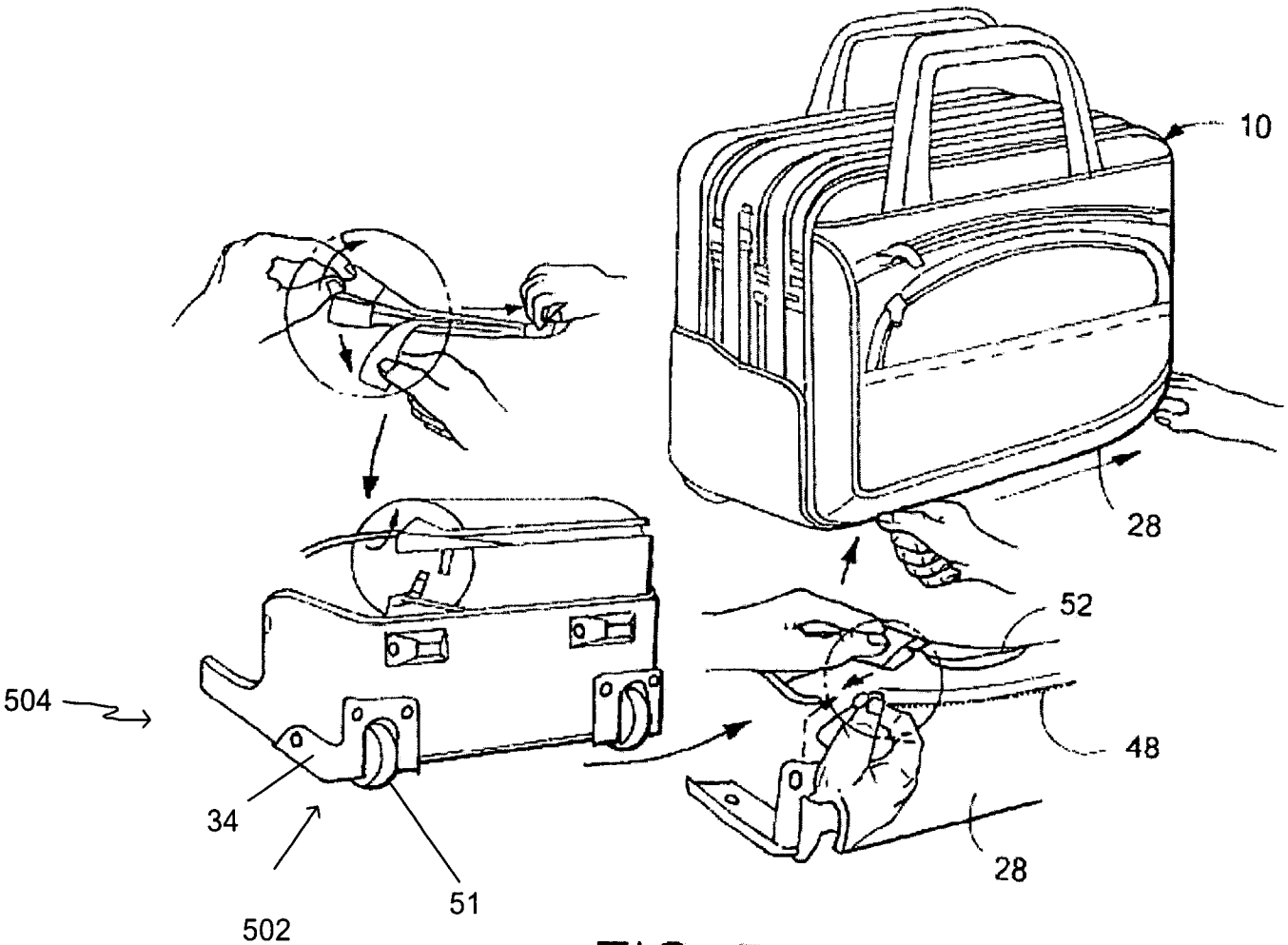
FIG. 5 is a front perspective view showing the case of FIG. 1 placed in the removable wheel and extendable handle assembly of FIG. 2, and a series of detail figures illustrating the attachment process at the bottom of the combined assembly.

Referring to FIGS. 5, 6, and 8, the wheel housings 34 in one example cover various portions of the wheels 51. Referring to FIG. 5, the wheel housings 34 cover potion 502 of the wheels 51 at position 504 of the wheel and handle assembly 22. Referring to FIG. 6, the wheel housings 34 cover portion 606 of the wheels 51 at position 608 of the wheel and handle assembly 22. Reneging to FIG. 6, the wheel housings 34 cover portion 802 of the wheels 51 at position 804 of the wheel and handle assembly 22.

Figure 4:
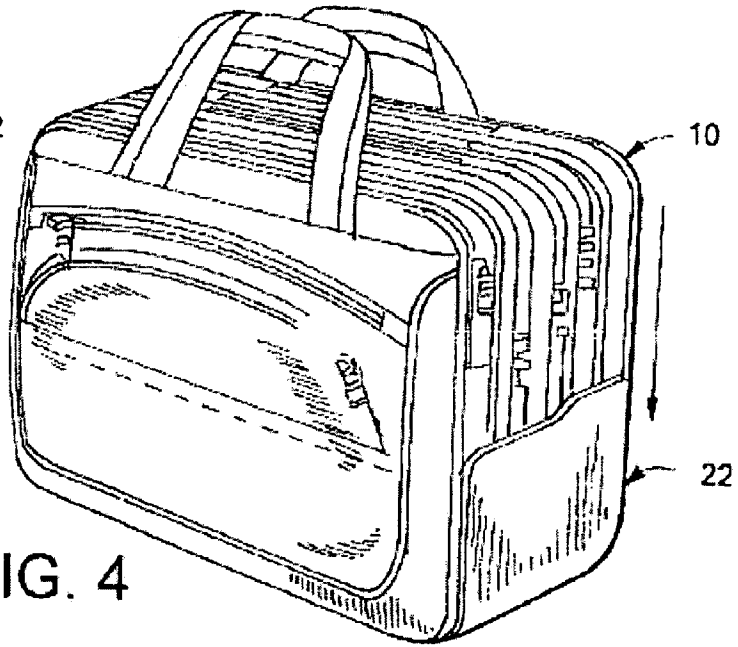
FIG. 4 is a perspective view showing the case of FIG. 1 placed in the removable wheel and extendable handle assembly of FIG. 2.
Figure 3:
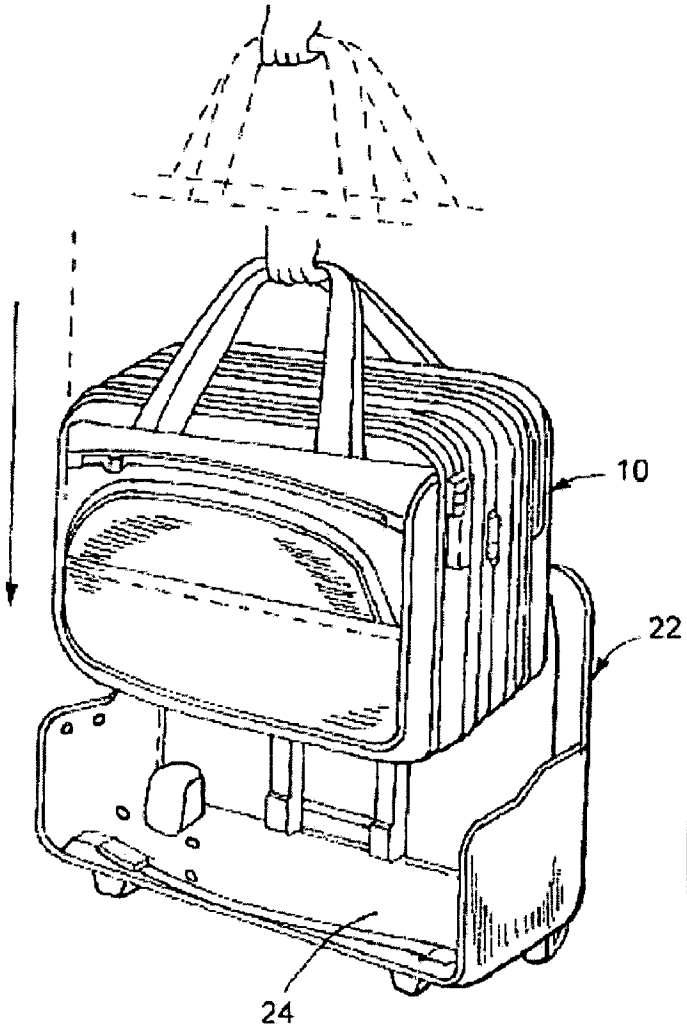
FIG. 3 is a perspective view showing the manner of placement of the case of FIG. 1 in the removable wheel and extendable handle assembly of FIG. 2.

Referring to FIGS. 3 and 4, business case 10 is shown being lowered and inserted in housing shell 24 of wheel and handle assembly 22. Shell 24 is sized to provide a snug fit around case 10.

The small luggage case 10 is readily releasably securable to the wheel and handle assembly 22. Upon readily releasable securement in one example, the face 106 of the small luggage case 10 abuts the face 206 of the wheel and handle assembly 22. The top 102 of the small luggage case 10 is adjacent to the top 202 of the wheel and handle assembly 22. The bottom 104 of the small luggage case 10 is adjacent to the bottom 204 of the wheel and handle assembly 22. The side 110 of the small luggage case 10 is adjacent to the side 210 of the wheel and handle assembly 22. The side 112 of the small luggage case 10 is adjacent to the side 212 of the wheel and handle assembly 22. Referring to FIG. 5, business case 10 is attached to the leading edge of shell base 28. The means of attachment in the illustrated embodiment zippers at the front bottom edge of the assembly and at the back top and sides of the assembly. It is anticipated, however, that other suitable attaching means could be used, including snaps and hook and loop fastening means. In addition, it is anticipated that the fastening means used in the various embodiments of the present invention could be lockable to secure business case 10 to shell base 28. In this embodiment, the lower frontal attachment is made by mating zipper half 52, stitched to the front bottom edge of case 10, and lower zipper half 48, stitched to the leading edge of shell base 28.

Similarly, as shown in FIG. 6, zipper half 54, stitched adjacent to and around the upper rear sides and the top rear edge of case 10, and upper zipper half 46 on shell 24 are sized and located to mate, forming a complete zipper around the rear top edge and upper rear sides of the assembly.

The small luggage case 10 comprises perimeter 602 about the face 106. The zipper half 54 in one example is stitched along a number of portions of the perimeter 602. For example, the zipper half 54 is stitched along the side 110, the top 102, and the side 112.

The wheel and handle assembly 22 comprises perimeter 604 about the face 206. The upper zipper half 46 in one example is stitched along a number of portions of the perimeter 604. For example, the upper zipper half 46 is stitched along the side 210, the top 202, and the side 212.

Figure 7:
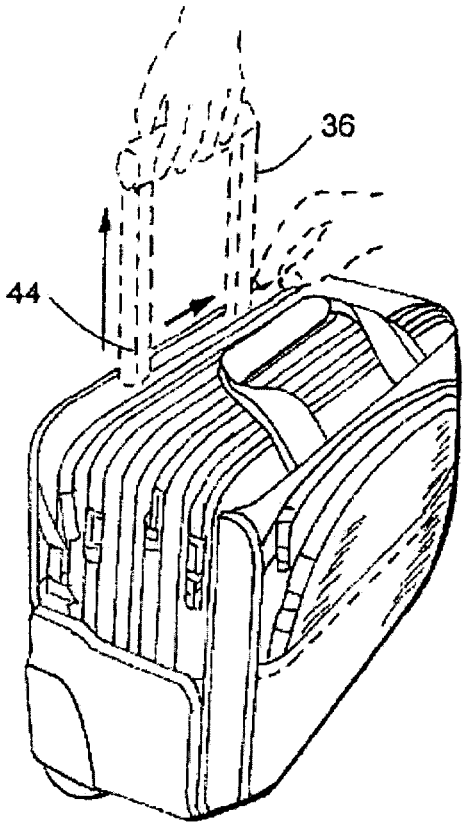
FIG. 7 is a perspective view showing the case of FIG. 1 being finally secured in the removable wheel and extendable handle assembly of FIG. 2, with the extendable handle partially extended.

FIGS. 7 and 8 illustrate the completely assembled unit. In FIG. 7, telescoping extendable handle 36 is extracted from access zipper 44 so that the case may be pulled behind the user.

Figure 9:
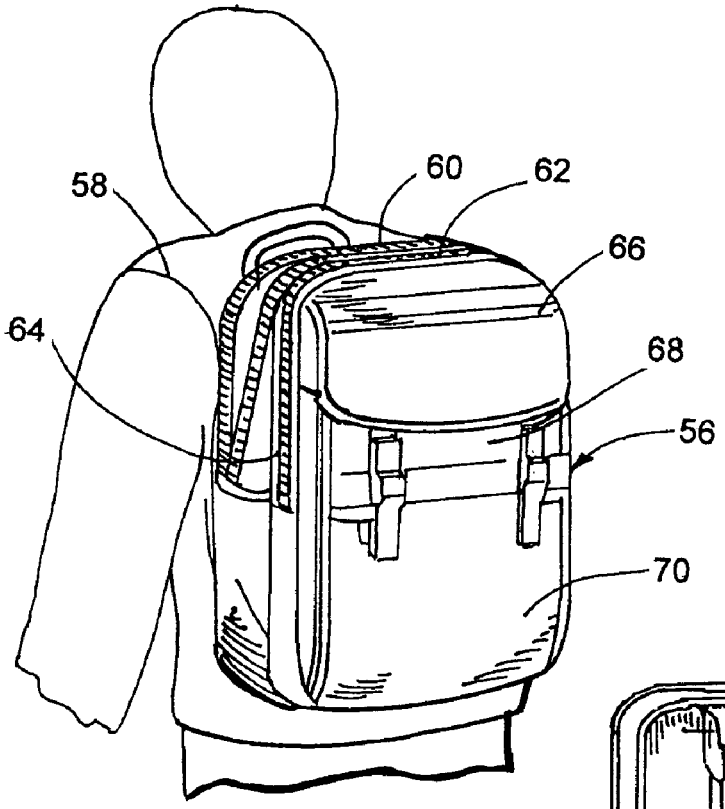
FIG. 9; is a general perspective view of a back pack in accordance with an alternative embodiment this invention.
Figure 10:
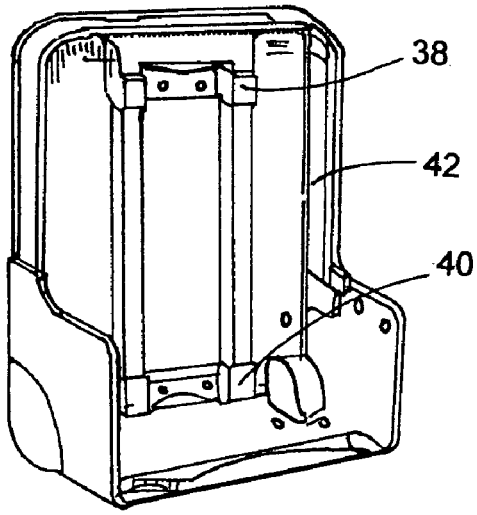
FIG. 10 is a perspective view of a removable wheel and extendable handle assembly in accordance with this invention for use with the case shown in FIG. 9.
Figure 11:
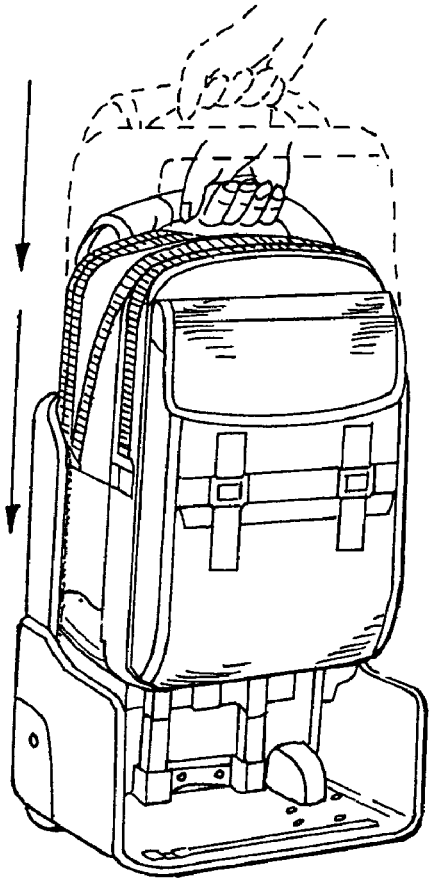
FIG. 11 is a perspective view showing the manner of placement of the case of FIG. 9 in the removable wheel and extendable handle assembly of FIG. 10.
Figure 12:
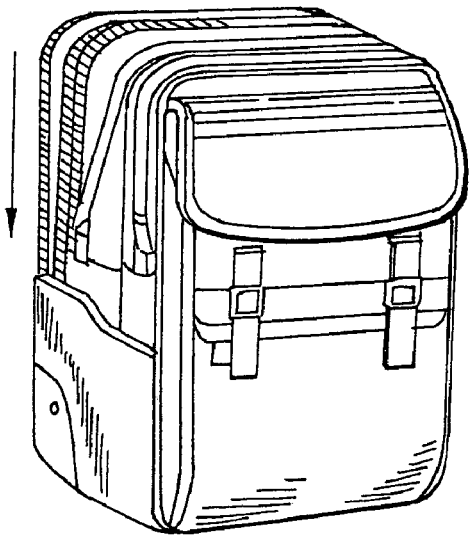
FIG. 12 is a perspective view showing the case of FIG. 9 placed in the removable wheel and extendable handle assembly of FIG. 10.
Figure 13:
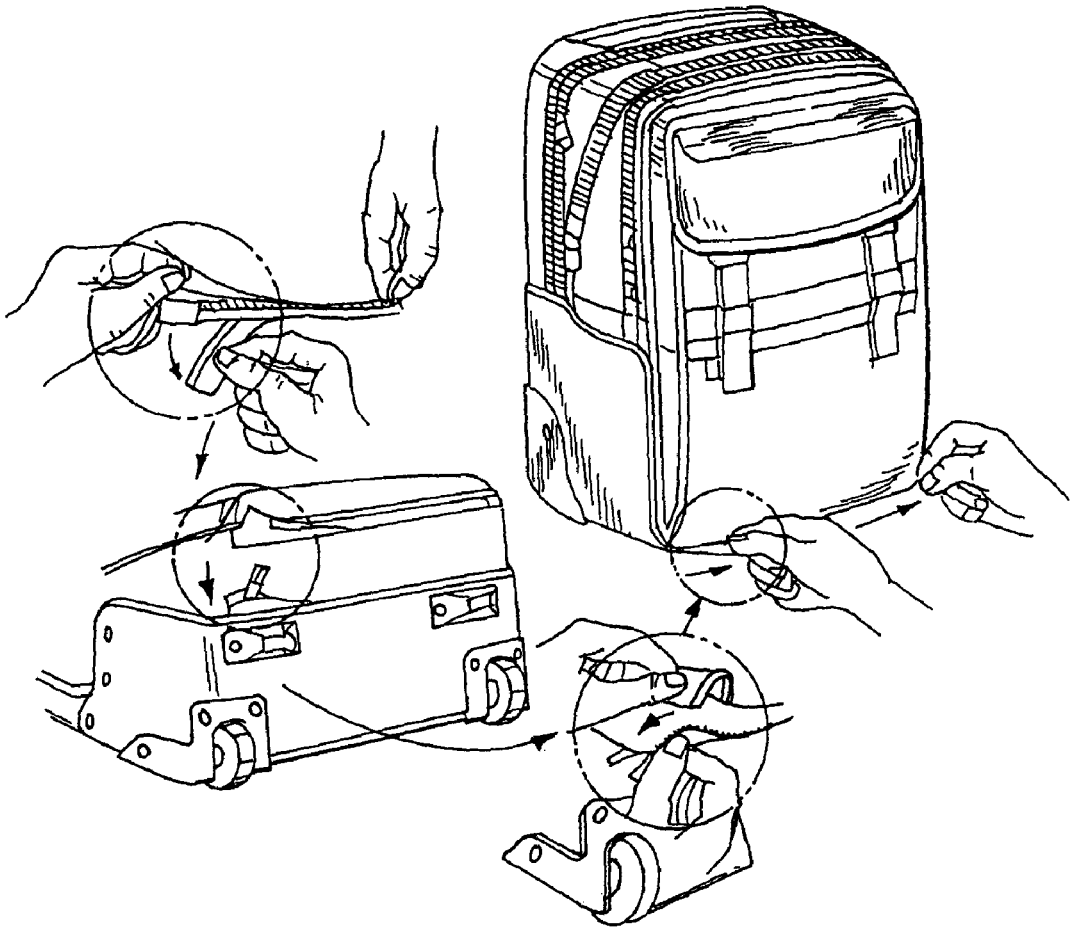
FIG. 13 is a perspective view showing the case of FIG. 9 placed in the removable wheel and extendable handle assembly of FIG. 10, and a series of detail figures illustrating the attachment process at the bottom of the combined assembly.
Figure 14:
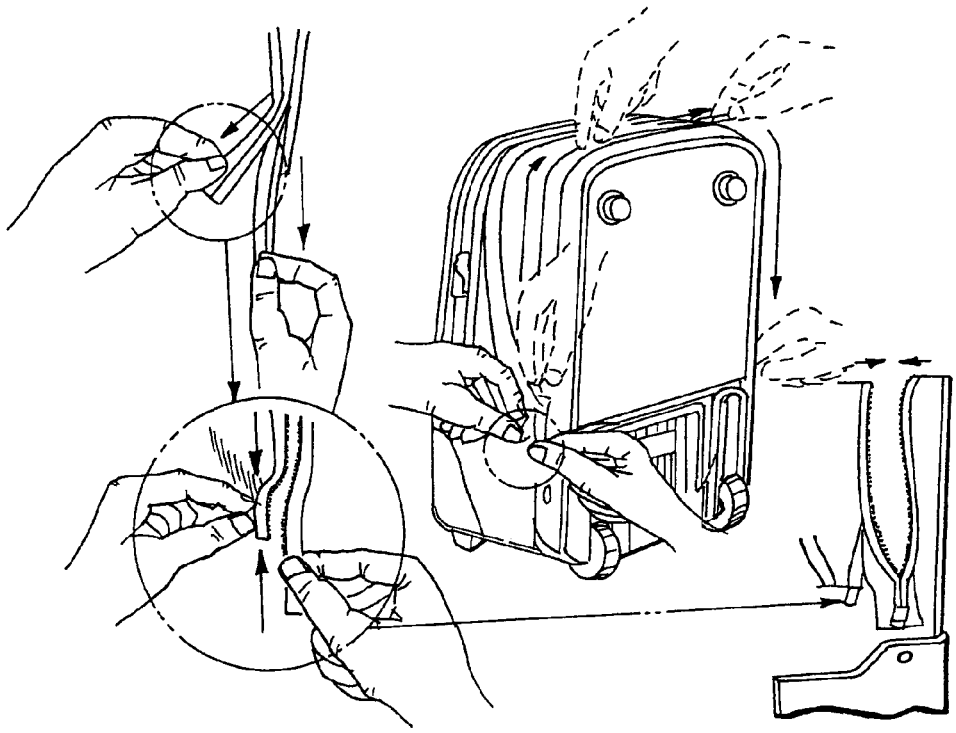
FIG. 14 is a perspective view showing the case of FIG. 9 placed in the removable wheel and extendable handle assembly of FIG. 10, and a series of detail figures illustrating the attachment process at the top and sides of the combined assembly.
Figure 15:
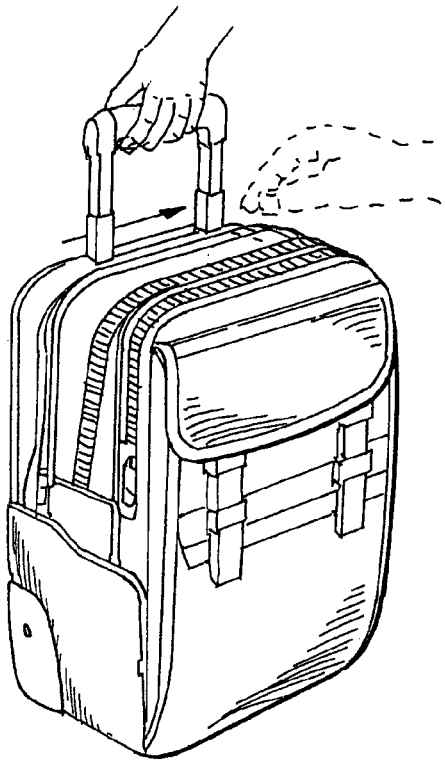
FIG. 15 is a perspective view showing the case of FIG. 9 being finally secured in the removable wheel and extendable handle assembly of FIG. 10, with the extendable handle partially extended.
Figure 16:
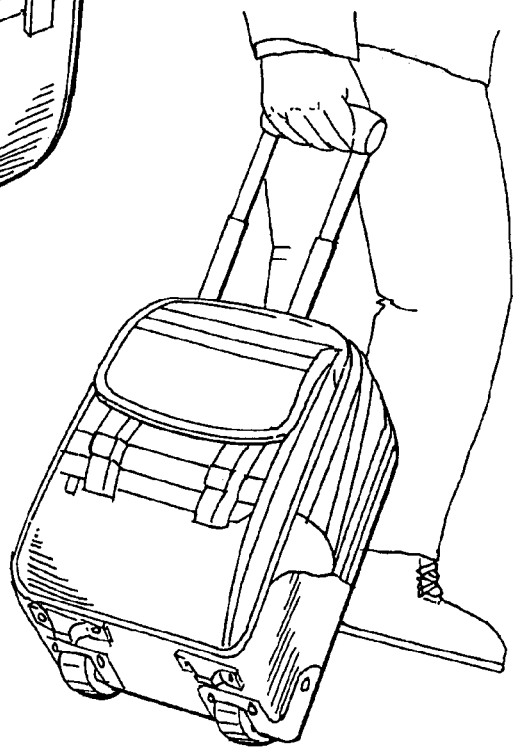
FIG. 16 is a perspective view showing the case of FIG. 9 secured in the removable wheel and extendable handle assembly of FIG. 10, with the extendable handle extended and being used to pull the case.

An alternative embodiment of the present invention is shown in FIGS. 9–16. Referring to FIG. 9, back pack 56 is provided with a pair of shoulder straps 58, one of which is shown, so as to be carried by the user. The back pack 56 is generally of a rectangular shape, with access being provided to three main storage compartments by zippers 60, 62, and 64. Auxiliary storage compartments 66, 68, 70 are provided on one side of back pack 56. This embodiment of the present invention differs from the previously described embodiment only in that back pack 56 is vertical in aspect rather than horizontal like business case 10 of the first described embodiment.

While only two embodiments of the invention have been shown, it should be apparent to those skilled in the art that what has been described is considered at present to be a preferred embodiment of the roller wheel assembly for a tracked vehicle of this invention. In accordance with the Patent Statute, changes may be made in the roller wheel assembly for a tracked vehicle without actually departing from the true spirit and scope of this invention. The appended claims are intended to cover all such changes and modification which fall in the true spirit and scope of this invention.

What is claimed is:

1. An apparatus, comprising:

a small luggage case that comprises a top, bottom, first face, second face, first side, and second side, wherein the small luggage case is generally of a rectangular shape, wherein the small luggage case comprises a first dimension between the top and the bottom, wherein the small luggage case comprises a second dimension between the first side and the second side, wherein the first face of the small luggage case comprises a perimeter; and a wheel and handle assembly that comprises a top, bottom, first face, second face, first side, and second side, wherein the wheel and handle assembly comprises a first dimension between the top and the bottom, wherein the wheel and handle assembly comprises a second dimension between the first side and the second side, wherein the first face of the wheel and handle assembly comprises a perimeter;

wherein the first dimension of the small luggage case and the first dimension of the wheel and handle assembly comprise a substantially same first dimension, wherein the second dimension of the small luggage case and the second dimension of the wheel and handle assembly comprise a substantially same second dimension;

wherein the small luggage case and the wheel and handle assembly comprise a plurality of readily releasable securement devices, wherein a readily releasable securement device of the plurality of readily releasable securement devices is employable to readily releasably secure the small luggage case to the wheel and handle assembly along:

a portion of the perimeter of the first face of the small luggage case; and a portion of the perimeter of the first face of the wheel and handle assembly such that:

the first face of the small luggage case abuts the first face of the wheel and handle assembly;

the top of the small luggage case is adjacent to the top of the wheel and handle assembly;

the bottom of the small luggage case is adjacent to the bottom of the wheel and handle assembly;

the first side of the small luggage case is adjacent to the first side of the wheel and handle assembly; and the second side of the small luggage case is adjacent to the second side of the wheel and handle assembly.

2. The apparatus of claim 1, wherein the readily releasable securement device comprises complementary first and second portions;

wherein the small luggage case comprises the complementary first portion of the readily releasable securement device, wherein the wheel and handle assembly comprises the complementary second portion of the readily releasable securement device;

wherein the first face of the small luggage case comprises an outer edge, wherein the complementary first portion of the readily releasable securement device is located about a portion of the outer edge of the first face of the small luggage case;

wherein the first face of the wheel and handle assembly comprises an outer edge, wherein the complementary second portion of the readily releasable securement device is located about a portion of the outer edge of the first face of the wheel and handle assembly;

wherein the complementary first and second portions of the readily releasable securement device are employable in a cooperative relationship for readily releasable securement of the small luggage case to the wheel and handle assembly.

3. The apparatus of claim 2, wherein the readily releasable securement device comprises a zipper, wherein the complementary first portion of the zipper is stitched to the outer edge of the first face of the small luggage case, wherein the complementary second portion of the zipper is stitched to the outer edge of the first face of the wheel and handle assembly;

wherein the complementary first and second portions of the zipper are employable in the cooperative relationship for readily releasable securement of the small luggage case to the wheel and handle assembly such that the first face of the small luggage case is abuttable with the first face of the wheel and handle assembly.

4. The apparatus of claim 2, wherein the complementary first portion of the readily releasable securement device is movably locatable about an entirety of the outer edge of the first face of the small luggage case;

wherein the complementary second portion of the readily releasable securement device is movably locatable about an entirety of the outer edge of the first face of the wheel and handle assembly.

5. The apparatus of claim 2, wherein the complementary first portion of the readily releasable securement device comprises a first zipper half movably locatable about an entirety of the outer edge of the first face of the small luggage case;

wherein the complementary second portion of the readily releasable securement device comprises a second zipper half movably locatable about an entirety of the outer edge of the first face of the wheel and handle assembly;

wherein the first zipper half and the second zipper half are employable in a cooperative relationship for readily releasable securement of the small luggage case to the wheel and handle assembly such that the first face of the small luggage case is abuttable with the first face of the wheel and handle assembly.

6. The apparatus of claim 1, wherein the readily releasable securement device comprises one or more of zippers, snaps, and/or hook and loop fasteners.

7. The apparatus of claim 1, wherein the wheel and handle assembly comprises an extendable handle that is employable by a user to roll the small luggage case and the wheel and handle assembly.

8. The apparatus of claim 7, wherein the extendable handle is slidably mounted at the second face of the wheel and handle assembly.

9. The apparatus of claim 8, wherein the second face of the wheel and handle assembly comprises a bracket arrangement, wherein the extendable handle is slidably mounted at the second face of the wheel and handle assembly through employment of the bracket arrangement.

10. The apparatus of claim 9, wherein the extendable handle is slidably mounted to the wheel and handle assembly;

wherein upon a complete telescopic collapse of the extendable handle:

along a direction substantially orthogonal relative to the top of the wheel and handle assembly; and toward the bottom of the wheel and handle assembly;

a substantial portion of the extendable handle is telescopically received within the bracket arrangement.

11. The apparatus of claim 10, wherein upon a complete telescopic extension of the extendable handle:

along the direction substantially orthogonal relative to the top of the wheel and handle assembly; and away from the bottom of the wheel and handle assembly a substantial portion of the extendable handle is located outside the bracket arrangement, distally outward from the top of the wheel and handle assembly, and away from the bottom of the wheel and handle assembly.

12. The apparatus of claim 9, wherein the bracket arrangement comprises an upper bracket and a lower bracket, wherein the extendable handle is slidably mounted at the second face of the wheel and handle assembly through employment of the upper bracket and the lower bracket.

13. The apparatus of claim 12, wherein upon a complete telescopic collapse of the extendable handle:

along a direction substantially orthogonal relative to the top of the wheel and handle assembly; and toward the bottom of the wheel and handle assembly;

a substantial portion of the extendable handle is telescopically received between the upper bracket and the lower bracket.

14. The apparatus of claim 13, wherein upon a complete telescopic extension of the extendable handle:

along the direction substantially orthogonal relative to the top of the wheel and handle assembly; and away from the bottom of the wheel and handle assembly;

a substantial portion of the extendable handle is located outside the bracket arrangement, distally outward from the top of the wheel and handle assembly, and away from the bottom of the wheel and handle assembly.

15. The apparatus of claim 7, wherein the extendable handle is slidably mounted to the wheel and handle assembly:

wherein the extendable handle is telescopically extendable and collapsible along a direction substantially orthogonal relative to the top of the wheel and handle assembly.

16. The apparatus of claim 15, wherein upon a complete telescopic collapse of the extendable handle along the direction substantially orthogonal relative to the top of the wheel and handle assembly and toward the bottom of the wheel and handle assembly, a substantial portion of the extendable handle superimposes the second face of the wheel and handle assembly.

17. The apparatus of claim 16, wherein upon a complete telescopic extension of the extendable handle along the direction substantially orthogonal relative to the top of the wheel and handle assembly and away from the bottom of the wheel and handle assembly, a substantial portion of the extendable handle is located distally outward from the top of the wheel and handle assembly and away from the bottom of the wheel and handle assembly.

18. The apparatus of claim 7, wherein the extendable handle is slidably mounted to the wheel and handle assembly:

wherein the extendable handle comprises a telescopic handle.

19. The apparatus of claim 7, wherein the extendable handle is slidably mounted to the wheel and handle assembly:

wherein the extendable handle is extendable between:

a first position proximate to the top of the wheel and handle assembly; and a second position distally outward from the top of the wheel and handle assembly and away from the bottom of the wheel and handle assembly.

20. The apparatus of claim 19, wherein upon a location of the extendable handle at the first position proximate to the top of the wheel and handle assembly, a substantial portion of the extendable handle superimposes the second face of the wheel and handle assembly.

21. The apparatus of claim 20, wherein upon a location of the extendable handle at the second position distally outward from the top of the wheel and handle assembly and away from the bottom of the wheel and handle assembly, a substantial portion of the extendable handle is located distally outward from the top of the wheel and handle assembly and away from the bottom of the wheel and handle assembly.

22. The apparatus of claim 19, wherein the top of the wheel and handle assembly comprises an access zipper;

wherein the extendable handle is extendable, through the access zipper when the access zipper is open, between:

the first position proximate to the top of the wheel and handle assembly; and the second position distally outward from the top of the wheel and handle assembly and away from the bottom of the wheel and handle assembly.

23. The apparatus of claim 1, wherein the second face and the bottom of the wheel and handle assembly comprise a wheel housing arrangement.

24. The apparatus of claim 23, wherein the wheel and handle assembly comprises a plurality of wheels rotatably mounted within the wheel housing arrangement.

25. The apparatus of claim 24, wherein the wheel housing arrangement covers a portion of the plurality of wheels.

26. The apparatus of claim 25, wherein the portion of the plurality of wheels comprises a first portion of the plurality of wheels at a first position of the wheel and handle assembly, a second portion of the plurality of wheels at a second position of the wheel and handle assembly, and a third portion of the plurality of wheels at a third position of the wheel and handle assembly.

27. The apparatus of claim 25, wherein the wheel housing arrangement conforms in shape to the portion of the plurality of wheels.

28. The apparatus of claim 27, wherein the wheel housing arrangement is contoured to accommodate the portion of the plurality of wheels.

29. The apparatus of claim 28, wherein the portion of the plurality of wheels comprises a first portion of the plurality of wheels at a first position of the wheel and handle assembly, a second portion of the plurality of wheels at a second position of the wheel and handle assembly, and a third portion of the plurality of wheels at a third position of the wheel and handle assembly.

30. The apparatus of claim 24, wherein the wheel housing arrangement comprises a first wheel housing and a second wheel housing, wherein the plurality of wheels comprise a first wheel and a second wheel;

wherein the first wheel is rotatably mounted within the first wheel housing, wherein the second wheel is rotatably mounted within the second wheel housing.

31. The apparatus of claim 30, wherein the first wheel housing covers a portion of the first wheel, wherein the second wheel housing covers a portion of the second wheel.

32. The apparatus of claim 31, wherein the portion of the first wheel comprises a first portion of the first wheel, wherein the portion of the second wheel comprises a first portion of the second wheel;

wherein the first wheel housing covers the first portion of the first wheel and the second wheel housing covers the first portion of the second wheel at a first position of the wheel and handle assembly;

wherein the first wheel housing covers a second portion of the first wheel and the second wheel housing covers a second portion of the second wheel at a second position of the wheel and handle assembly;

wherein the first wheel housing covers a third portion of the first wheel and the second wheel housing covers a third portion of the third wheel at a third position of the wheel and handle assembly.

33. The apparatus of claim 31, wherein the first wheel housing conforms in shape to the portion of the first wheel, wherein the second wheel housing conforms in shape to the portion of the second wheel.

34. The apparatus of claim 33, wherein the first wheel housing is contoured to accommodate the portion of the first wheel, wherein the second wheel housing is contoured to accommodate the portion of the second wheel.

35. The apparatus of claim 34, wherein the portion of the first wheel comprises a first portion of the first wheel, wherein the portion of the second wheel comprises a first portion of the second wheel;

wherein the first wheel housing covers the first portion of the first wheel and the second wheel housing covers the first portion of the second wheel at a first position of the wheel and handle assembly;

wherein the first wheel housing covers a second portion of the first wheel and the second wheel housing covers a second portion of the second wheel at a second position of the wheel and handle assembly;

wherein the first wheel housing covers a third portion of the first wheel and the second wheel housing covers a third portion of the third wheel at a third position of the wheel and handle assembly.

36. The apparatus of claim 31, wherein the first wheel comprises first and second major faces, wherein the second wheel comprises first and second major faces;

wherein the first wheel housing partially covers the first and second major faces of the first wheel, wherein the second wheel housing partially covers the first and second major faces of the second wheel.

37. The apparatus of claim 36, wherein the first wheel comprises the first and second major faces and a rim, wherein the portion of the first wheel comprises a portion of the first and second major faces and the rim;

wherein the second wheel comprises the first and second major faces and a rim, wherein the portion of the second wheel comprises a portion of the first and second major faces and the rim;

wherein the first wheel housing conforms in shape to the portion of the first and second major faces and the rim of the first wheel, wherein the second wheel housing conforms in shape to the portion of the first and second major faces and the rim of the second wheel.

38. The apparatus of claim 37, wherein the first wheel housing is contoured to accommodate the portion of the first and second major faces and the rim of the first wheel, wherein the second wheel housing is contoured to accommodate the portion of the first and second major faces and the rim of the second wheel.

39. The apparatus of claim 30, wherein the first wheel is spaced apart from the second wheel, the apparatus further comprising:

a first foot; and a second foot that is spaced apart from the first foot, wherein upon a location of the small luggage case and the wheel and handle assembly in a substantially upright position, the small luggage case, the first wheel, the second wheel, the first foot, and the second foot comprise a support relationship.

40. The apparatus of claim 24, further comprising:

a plurality of feet, wherein upon a location of the small luggage case and the wheel and handle assembly in a substantially upright position, the small luggage case, the plurality of wheels, and the plurality of feet comprise a support relationship.

41. The apparatus of claim 1, wherein the second face and the bottom of the wheel and handle assembly comprise a contoured wheel housing arrangement.

42. The apparatus of claim 1, wherein the substantially same second dimension between the first side and the second side of the small luggage case and between the first side and the second side of the wheel and handle assembly is larger than the substantially same first dimension between the top and the bottom of the small luggage case and between the top and the bottom of the wheel and handle assembly.

43. The apparatus of claim 1, wherein the substantially same first dimension between the top and the bottom of the small luggage case and between the top and the bottom of the wheel and handle assembly is larger than the substantially same second dimension between the first side and the second side of the small luggage case and between the first side and the second side of the wheel and handle assembly.

44. The apparatus of claim 1, wherein the small luggage case comprises one or more straps that are employable by a user to carry the small luggage case.

45. The apparatus of claim 44, wherein the one or more straps comprise:

a shoulder strap; or a plurality of backpack straps.

46. The apparatus of claim 45, wherein the one or more straps comprise the shoulder strap and a plurality of hand straps, wherein the shoulder strap is employable by the user to carry the small luggage case, wherein the plurality of hand straps are employable by the user to carry the small luggage case.

47. The apparatus of claim 46, wherein the substantially same second dimension between the first side and the second side of the small luggage case and between the first side and the second side of the wheel and handle assembly is larger than the substantially same first dimension between the top and the bottom of the small luggage case and between the top and the bottom of the wheel and handle assembly;

wherein the shoulder strap is employable by the user to carry the small luggage case as a business case, wherein the plurality of hand straps are employable by the user to carry the small luggage case as the business case.

48. The apparatus of claim 45, wherein the one or more straps comprise the plurality of backpack straps, wherein the plurality of backpack straps are secured to the first side and the second side of the small luggage case, wherein the plurality of backpack straps are employable by the user to carry the small luggage case as a backpack.

49. The apparatus of claim 48, wherein the substantially same first dimension between the top and the bottom of the small luggage case and between the top and the bottom of the wheel and handle assembly is larger than the substantially same second dimension between the first side and the second side of the small luggage case and between the first side and the second side of the wheel and handle assembly.

50. The apparatus of claim 48, wherein the small luggage case comprises one or more auxiliary compartments located at the second face of the small luggage case.

51. The apparatus of claim 1, further comprising:

a plurality of feet, wherein upon a location of the small luggage case and the wheel and handle assembly in a substantially upright position, the small luggage case and the plurality of feet comprise a support relationship.

52. The apparatus of claim 1, wherein the small luggage case comprises a wear-resistant fabric.

53. The apparatus of claim 1, wherein the top and the bottom of the small luggage case are substantially parallel, wherein the first face and the second face of the small luggage case are substantially parallel, wherein the first side and the second side of the small luggage case are substantially parallel.

54. The apparatus of claim 1, wherein the readily releasable securement device of the plurality of readily releasable securement devices is employable to readily releasably secure a plurality of portions of the perimeter of the first face of the small luggage case to a plurality of portions of the perimeter of the first face of the wheel and handle assembly.

55. The apparatus of claim 54, wherein the plurality of portions of the perimeter of the first face of the small luggage case comprise two or more of:

the top;

the first side; and the second side of the small luggage case;

wherein the plurality of portions of the perimeter of the first face of the wheel and handle assembly comprise two or more of:

the top;

the first side; and the second side of the wheel and handle assembly.

56. The apparatus of claim 54, wherein the plurality of portions of the perimeter of the first face of the small luggage case comprise the top, the first side, and the second side of the small luggage case;

wherein the plurality of portions of the perimeter of the first face of the wheel and handle assembly comprise the top, the first side, and the second side of the wheel and handle assembly.

57. The apparatus of claim 54, wherein the plurality of portions of the perimeter of the first face of the small luggage case comprise a first portion, a second portion, and a third portion;

wherein the plurality of portions of the perimeter of the first face of the wheel and handle assembly comprise a first portion, a second portion, and a third portion;

wherein the readily releasable securement device of the plurality of readily releasable securement devices is employable to readily releasably secure the first portion of the perimeter of the first face of the small luggage case to the first portion of the perimeter of the first face of the wheel and handle assembly;

wherein the readily releasable securement device of the plurality of readily releasable securement devices is employable to readily releasably secure the second portion of the perimeter of the first face of the small luggage case to the second portion of the perimeter of the first face of the wheel and handle assembly;

wherein the readily releasable securement device of the plurality of readily releasable securement devices is employable to readily releasably secure the third portion of the perimeter of the first face of the small luggage case to the third portion of the perimeter of the first face of the wheel and handle assembly.

58. The apparatus of claim 57, wherein the first portion of the perimeter of the first face of the small luggage case comprises a portion along the first side of the small luggage case;

wherein the first portion of the perimeter of the first face of the wheel and handle assembly comprises a portion along the first side of the wheel and handle assembly;

wherein the second portion of the perimeter of the first face of the small luggage case comprises a portion along the top of the small luggage case;

wherein the second portion of the perimeter of the first face of the wheel and handle assembly comprises a portion along the top of the wheel and handle assembly;

wherein the third portion of the perimeter of the first face of the small luggage case comprises a portion along the second side of the small luggage case;

wherein the third portion of the perimeter of the first face of the wheel and handle assembly comprises a portion along the second side of the wheel and handle assembly.

59. The apparatus of claim 55, wherein the second face and the bottom of the wheel and handle assembly comprise a wheel housing arrangement.

60. The apparatus of claim 59, wherein the wheel and handle assembly comprises a plurality of wheels rotatably mounted within the wheel housing arrangement.

61. The apparatus of claim 60, wherein the wheel housing arrangement comprises a first wheel housing and a second wheel housing, wherein the plurality of wheels comprise a first wheel and a second wheel;

wherein the first wheel is rotatably mounted within the first wheel housing, wherein the second wheel is rotatably mounted within the second wheel housing.

62. The apparatus of claim 61, wherein the first wheel is spaced apart from the second wheel, the apparatus further comprising:

a first foot; and a second foot that is spaced apart from the first foot, wherein upon a location of the small luggage case and the wheel and handle assembly in a substantially upright position, the small luggage case, the first wheel, the second wheel, the first foot, and the second foot comprise a support relationship.

63. The apparatus of claim 62, further comprising:

a plurality of feet that comprise the first foot and the second foot, wherein upon a location of the small luggage case and the wheel and handle assembly in a substantially upright position, the small luggage case, the plurality of wheels, and the plurality of feet comprise a support relationship.

64. The apparatus of claim 1, wherein the small luggage case comprises a business case;

wherein the business case comprises the top, the bottom, the first face, the second face, the first side, and the second side, wherein the business case is generally of the rectangular shape, wherein the business case comprises the first dimension between the top and the bottom, wherein the business case comprises the second dimension between the first side and the second side, wherein the first face of the business case comprises the perimeter.

65. The apparatus of claim 23, wherein the wheel housing arrangement comprises a skid plate along the second face of the wheel and handle assembly.

66. An apparatus, comprising:

a small luggage case that comprises a top, bottom, first face, second face, first side, and second side, wherein the small luggage case comprises a first dimension between the top and the bottom, wherein the small luggage case comprises a second dimension between the first side and the second side, wherein the first face of the small luggage case comprises a perimeter; and a wheel and handle assembly that comprises a top, bottom, first face, second face, first side, and second side, wherein the second face of the wheel and handle assembly comprises a wheel housing arrangement, wherein the wheel and handle assembly comprises a first dimension between the top and the bottom, wherein the wheel and handle assembly comprises a second dimension between the first side and the second side, wherein the first face of the wheel and handle assembly comprises a perimeter;

wherein the first dimension of the small luggage case and the first dimension of the wheel and handle assembly comprise a substantially same first dimension, wherein the second dimension of the small luggage case and the second dimension of the wheel and handle assembly comprise a substantially same second dimension;

wherein the small luggage case and the wheel and handle assembly comprise a plurality of readily releasable securement devices, wherein a readily releasable securement device of the plurality of readily releasable securement devices is employable to readily releasably secure the small luggage case to the wheel and handle assembly along:

a portion of the perimeter of the first face of the small luggage case; and a portion of the perimeter of the first face of the wheel and handle assembly such that:

the first face of the small luggage case abuts the first face of the wheel and handle assembly;

the top of the small luggage case is adjacent to the top of the wheel and handle assembly;

the bottom of the small luggage case is adjacent to the bottom of the wheel and handle assembly;

the first side of the small luggage case is adjacent to the first side of the wheel and handle assembly; and the second side of the small luggage case is adjacent to the second side of the wheel and handle assembly.

67. The apparatus of claim 66, wherein the wheel and handle assembly comprises a plurality of wheels rotatably mounted within the wheel housing arrangement.

68. The apparatus of claim 67, wherein the wheel housing arrangement covers a portion of the plurality of wheels.

69. The apparatus of claim 68, wherein the portion of the plurality of wheels comprises a first portion of the plurality of wheels;

wherein the wheel housing arrangement covers the first portion of the plurality of wheels at a first position of the wheel and handle assembly, a second portion of the plurality of wheels at a second position of the wheel and handle assembly, and a third portion of the plurality of wheels at a third position of the wheel and handle assembly.

70. The apparatus of claim 68, wherein the wheel housing arrangement conforms in shape to the portion of the plurality of wheels.

71. The apparatus of claim 70, wherein the wheel housing arrangement is contoured to accommodate the portion of the plurality of wheels.

72. The apparatus of claim 71, wherein the portion of the plurality of wheels comprises a first portion of the plurality of wheels;

wherein the wheel housing arrangement is contoured to accommodate the first portion of the plurality of wheels at a first position of the wheel and handle assembly, a second portion of the plurality of wheels at a second position of the wheel and handle assembly, and a third portion of the plurality of wheels at a third position of the wheel and handle assembly.

73. The apparatus of claim 67, wherein the wheel housing arrangement comprises a first wheel housing and a second wheel housing, wherein the plurality of wheels comprise a first wheel and a second wheel;

wherein the first wheel is rotatably mounted within the first wheel housing, wherein the second wheel is rotatably mounted within the second wheel housing.

74. The apparatus of claim 73, wherein the first wheel housing covers a portion of the first wheel, wherein the second wheel housing covers a portion of the second wheel.

75. The apparatus of claim 74, wherein the portion of the first wheel comprises a first portion of the first wheel, wherein the portion of the second wheel comprises a first portion of the second wheel;

wherein the first wheel housing covers the first portion of the first wheel and the second wheel housing covers the first portion of the second wheel at a first position of the wheel and handle assembly;

wherein the first wheel housing covers a second portion of the first wheel and the second wheel housing covers a second portion of the second wheel at a second position of the wheel and handle assembly;

wherein the first wheel housing covers a third portion of the first wheel and the second wheel housing covers a third portion of the third wheel at a third position of the wheel and handle assembly.

76. The apparatus of claim 74, wherein the first wheel housing conforms in shape to the portion of the first wheel, wherein the second wheel housing conforms in shape to the portion of the second wheel.

77. The apparatus of claim 76, wherein the first wheel housing is contoured to accommodate the portion of the first wheel, wherein the second wheel housing is contoured to accommodate the portion of the second wheel.

78. The apparatus of claim 77, wherein the portion of the first wheel comprises a first portion of the first wheel, wherein the portion of the second wheel comprises a first portion of the second wheel;

wherein the first wheel housing covers the first portion of the first wheel and the second wheel housing covers the first portion of the second wheel at a first position of the wheel and handle assembly;

wherein the first wheel housing covers a second portion of the first wheel and the second wheel housing covers a second portion of the second wheel at a second position of the wheel and handle assembly;

wherein the first wheel housing covers a third portion of the first wheel and the second wheel housing covers a third portion of the third wheel at a third position of the wheel and handle assembly.

79. The apparatus of claim 74, wherein the first wheel comprises first and second major faces, wherein the second wheel comprises first and second major faces;

wherein the first wheel housing partially covers the first and second major faces of the first wheel, wherein the second wheel housing partially covers the first and second major faces of the second wheel.

80. The apparatus of claim 79, wherein the first wheel comprises the first and second major faces and a rim, wherein the portion of the first wheel comprises a portion of the first and second major faces and the rim;

wherein the second wheel comprises the first and second major faces and a rim, wherein the portion of the second wheel comprises a portion of the first and second major faces and the rim;

wherein the first wheel housing conforms in shape to the portion of the first and second major faces and the rim of the first wheel, wherein the second wheel housing conforms in shape to the portion of the first and second major faces and the rim of the second wheel.

81. The apparatus of claim 80, wherein the first wheel housing is contoured to accommodate the portion of the first and second major faces and the rim of the first wheel, wherein the second wheel housing is contoured to accommodate the portion of the first and second major faces and the rim of the second wheel.

82. The apparatus of claim 73, wherein the first wheel is spaced apart from the second wheel, the apparatus further comprising:

a first foot; and a second foot that is spaced apart from the first foot, wherein upon a location of the small luggage case and the wheel and handle assembly in a substantially upright position, the small luggage case, the first wheel, the second wheel, the first foot, and the second foot comprise a support relationship.

83. The apparatus of claim 67, further comprising:

a plurality of feet, wherein upon a location of the small luggage case and the wheel and handle assembly in a substantially upright position, the small luggage case, the plurality of wheels, and the plurality of feet comprise a support relationship.

84. The apparatus of claim 66, wherein the wheel housing arrangement comprises a contoured wheel housing arrangement, wherein the second face and the bottom of the wheel and handle assembly comprise the contoured wheel housing arrangement.

85. The apparatus of claim 66, wherein the top and the bottom of the small luggage case are substantially parallel, wherein the first face and the second face of the small luggage case are substantially parallel, wherein the first side and the second side of the small luggage case are substantially parallel.

86. The apparatus of claim 66, wherein the wheel housing arrangement comprises a skid plate along the second face of the wheel and handle assembly.

87. The apparatus of claim 66, wherein the readily releasable securement device of the plurality of readily releasable securement devices is employable to readily releasably secure a plurality of portions of the perimeter of the first face of the small luggage case to a plurality of portions of the perimeter of the first face of the wheel and handle assembly.

88. The apparatus of claim 87, wherein the plurality of portions of the perimeter of the first face of the small luggage case comprise two or more of:

the top;

the first side; and the second side of the small luggage case;

wherein the plurality of portions of the perimeter of the first face of the wheel and handle assembly comprise two or more of:

the top;

the first side; and the second side of the wheel and handle assembly.

89. The apparatus of claim 87, wherein the plurality of portions of the perimeter of the first face of the small luggage case comprise the top, the first side, and the second side of the small luggage case;

wherein the plurality of portions of the perimeter of the first face of the wheel and handle assembly comprise the top, the first side, and the second side of the wheel and handle assembly.

90. The apparatus of claim 87, wherein the plurality of portions of the perimeter of the first face of the small luggage case comprise a first portion, a second portion, and a third portion;

wherein the plurality of portions of the perimeter of the first face of the wheel and handle assembly comprise a first portion, a second portion, and a third portion;

wherein the readily releasable securement device of the plurality of readily releasable securement devices is employable to readily releasably secure the first portion of the perimeter of the first face of the small luggage case to the first portion of the perimeter of the first face of the wheel and handle assembly;

wherein the readily releasable securement device of the plurality of readily releasable securement devices is employable to readily releasably secure the second portion of the perimeter of the first face of the small luggage case to the second portion of the perimeter of the first face of the wheel and handle assembly;

wherein the readily releasable securement device of the plurality of readily releasable securement devices is employable to readily releasably secure the third portion of the perimeter of the first face of the small luggage case to the third portion of the perimeter of the first face of the wheel and handle assembly.

91. The apparatus of claim 90, wherein the first portion of the perimeter of the first face of the small luggage case comprises a portion along the first side of the small luggage case;

wherein the first portion of the perimeter of the first face of the wheel and handle assembly comprises a portion along the first side of the wheel and handle assembly;

wherein the second portion of the perimeter of the first face of the small luggage case comprises a portion along the top of the small luggage case;

wherein the second portion of the perimeter of the first face of the wheel and handle assembly comprises a portion along the top of the wheel and handle assembly;

wherein the third portion of the perimeter of the first face of the small luggage case comprises a portion along the second side of the small luggage case;

wherein the third portion of the perimeter of the first face of the wheel and handle assembly comprises a portion along the second side of the wheel and handle assembly.

92. The apparatus of claim 66, wherein the small luggage case comprises a business case;

wherein the business case comprises the top, the bottom, the first face, the second face, the first side, and the second side, wherein the business case comprises the first dimension between the top and the bottom, wherein the business case comprises the second dimension between the first side and the second side, wherein the first face of the business case comprises the perimeter.

93. The apparatus of claim 66, wherein the wheel and handle assembly comprises an extendable handle that is employable by a user to roll the small luggage case and the wheel and handle assembly;

wherein the extendable handle is slidably mounted to the wheel and handle assembly;

wherein the wheel and handle assembly comprises a bracket arrangement, wherein the extendable handle is slidably mounted to the wheel and handle assembly through employment of the bracket arrangement;

wherein upon a complete telescopic collapse of the extendable handle:

along a direction substantially orthogonal relative to the top of the wheel and handle assembly; and toward the bottom of the wheel and handle assembly;

a substantial portion of the extendable handle is telescopically received within the bracket arrangement;

wherein upon a complete telescopic extension of the extendable handle:

along the direction substantially orthogonal relative to the top of the wheel and handle assembly; and away from the bottom of the wheel and handle assembly a substantial portion of the extendable handle is located outside the bracket arrangement, distally outward from the top of the wheel and handle assembly, and away from the bottom of the wheel and handle assembly.

94. The apparatus of claim 66, wherein the wheel and handle assembly comprises an extendable handle that is employable by a user to roll the small luggage case and the wheel and handle assembly;

wherein the extendable handle is slidably mounted to the wheel and handle assembly;

wherein the wheel and handle assembly comprises a bracket arrangement, wherein the extendable handle is slidably mounted to the wheel and handle assembly through employment of the bracket arrangement;

wherein the bracket arrangement comprises an upper bracket and a lower bracket, wherein the extendable handle is slidably mounted to the wheel and handle assembly through employment of the upper bracket and the lower bracket;

wherein upon a complete telescopic collapse of the extendable handle:

along a direction substantially orthogonal relative to the top of the wheel and handle assembly; and toward the bottom of the wheel and handle assembly;

a substantial portion of the extendable handle is telescopically received between the upper bracket and the lower bracket, wherein upon a complete telescopic extension of the extendable handle:

along the direction substantially orthogonal relative to the top of the wheel and handle assembly; and away from the bottom of the wheel and handle assembly;

a substantial portion of the extendable handle is located outside the bracket arrangement, distally outward from the top of the wheel and handle assembly, and away from the bottom of the wheel and handle assembly.

95. The apparatus of claim 66, wherein the wheel and handle assembly comprises an extendable handle that is employable by a user to roll the small luggage case and the wheel and handle assembly;

wherein the extendable handle is slidably mounted to the wheel and handle assembly;

wherein the extendable handle is telescopically extendable and collapsible along a direction substantially orthogonal relative to the top of the wheel and handle assembly;

wherein upon a complete telescopic collapse of the extendable handle along the direction substantially orthogonal relative to the top of the wheel and handle assembly and toward the bottom of the wheel and handle assembly, a substantial portion of the extendable handle superimposes the second face of the wheel and handle assembly;

wherein upon a complete telescopic extension of the extendable handle along the direction substantially orthogonal relative to the top of the wheel and handle assembly and away from the bottom of the wheel and handle assembly, a substantial portion of the extendable handle is located distally outward from the top of the wheel and handle assembly and away from the bottom of the wheel and handle assembly.

96. An apparatus, comprising:

a small luggage case that comprises a top, bottom, first face, second face, first side, and second side, wherein the small luggage case comprises a first dimension between the top and the bottom, wherein the small luggage case comprises a second dimension between the first side and the second side, wherein the first face of the small luggage case comprises a perimeter;

a wheel and handle assembly that comprises a top, bottom, first face, second face, first side, and second side, wherein the wheel and handle assembly comprises a first dimension between the top and the bottom, wherein the wheel and handle assembly comprises a second dimension between the first side and the second side, wherein the first face of the wheel and handle assembly comprises a perimeter; and a plurality of feet, wherein upon a location of the small luggage case and the wheel and handle assembly in a substantially upright position, the small luggage case and the plurality of feet comprise a support relationship;

wherein the first dimension of the small luggage case and the first dimension of the wheel and handle assembly comprise a substantially same first dimension, wherein the second dimension of the small luggage case and the second dimension of the wheel and handle assembly comprise a substantially same second dimension;

wherein the small luggage case and the wheel and handle assembly comprise a plurality of readily releasable securement devices, wherein a readily releasable securement device of the plurality of readily releasable securement devices is employable to readily releasably secure the small luggage case to the wheel and handle assembly along:

a portion of the perimeter of the first face of the small luggage case; and a portion of the perimeter of the first face of the wheel and handle assembly such that:

the first face of the small luggage case abuts the first face of the wheel and handle assembly;

the top of the small luggage case is adjacent to the top of the wheel and handle assembly;

the bottom of the small luggage case is adjacent to the bottom of the wheel and handle assembly;

the first side of the small luggage case is adjacent to the first side of the wheel and handle assembly; and the second side of the small luggage case is adjacent to the second side of the wheel and handle assembly.

97. The apparatus of claim 96, wherein the top and bottom of the small luggage case are substantially parallel, the first face and the second face of the small luggage case are substantially parallel, and the first side and the second side of the small luggage case are substantially parallel.

98. The apparatus of claim 96, wherein the small luggage case comprises a business case;

wherein the business case comprises the top, the bottom, the first face, the second face, the first side, and the second side, wherein the business case comprises the first dimension between the top and the bottom, wherein the business case comprises the second dimension between the first side and the second side, wherein the first face of the business case comprises the perimeter.

99. An apparatus, comprising:

a small luggage case that comprises a top, bottom, first face, second face, first side, and second side, wherein the small luggage case comprises a height between the top and the bottom, wherein the small luggage case comprises a width between the first side and the second side, wherein the first face of the small luggage case comprises a perimeter;

a wheel and handle assembly that comprises a top, bottom, first face, second face, first side, and second side, wherein the wheel and handle assembly comprises a height between the top and the bottom, wherein the wheel and handle assembly comprises a width between the first side and the second side, wherein the first face of the wheel and handle assembly comprises a perimeter;

wherein the height of the small luggage case and the height of the wheel and handle assembly comprise a substantially same height, wherein the width of the small luggage case and the width of the wheel and handle assembly comprise a substantially same width;

wherein the small luggage case and the wheel and handle assembly comprise a plurality of readily releasable securement devices, wherein a readily releasable securement device of the plurality of readily releasable securement devices is employable to readily releasably secure the small luggage case to the wheel and handle assembly along:

a portion of the perimeter of the first face of the small luggage case; and a portion of the perimeter of the first face of the wheel and handle assembly such that:

the first face of the small luggage case abuts the first face of the wheel and handle assembly;

the top of the small luggage case is adjacent to the top of the wheel and handle assembly;

the bottom of the small luggage case is adjacent to the bottom of the wheel and handle assembly;

the first side of the small luggage case is adjacent to the first side of the wheel and handle assembly; and the second side of the small luggage case is adjacent to the second side of the wheel and handle assembly.

100. The apparatus of claim 99, wherein the top and the bottom of the small luggage case are substantially parallel, wherein the first face and the second face of the small luggage case are substantially parallel, wherein the first side and the second side of the small luggage case are substantially parallel.

101. The apparatus of claim 99, wherein the small luggage case comprises a business case;

wherein the business case comprises the top, the bottom, the first face, the second face, the first side, and the second side, wherein the business case comprises the height between the top and the bottom, wherein the business case comprises the width between the first side and the second side, wherein the first face of the business case comprises the perimeter.

102. An apparatus, comprising:

a small luggage case that comprises a top, bottom, first face, second face, first side, and second side, wherein at least one portion of the small luggage case comprises a cross section that is generally of a rectangular shape, wherein the small luggage case comprises a first dimension between the top and the bottom, wherein the small luggage case comprises a second dimension between the first side and the second side, wherein the first face of the small luggage case comprises a perimeter;

a wheel and handle assembly that comprises a top, bottom, first face, second face, first side, and second side, wherein the wheel and handle assembly comprises a first dimension between the top and the bottom, wherein the wheel and handle assembly comprises a second dimension between the first side and the second side, wherein the wheel and handle assembly comprises a perimeter of the first face of the wheel and handle assembly; and an extendable handle that is employable by a user to roll the small luggage case and the wheel and handle assembly;

wherein the first dimension of the small luggage case and the first dimension of the wheel and handle assembly comprise a substantially same first dimension, wherein the second dimension of the small luggage case and the second dimension of the wheel and handle assembly comprise a substantially same second dimension;

wherein the small luggage case and the wheel and handle assembly comprise a plurality of readily releasable securement devices, wherein a readily releasable securement device of the plurality of readily releasable securement devices is employable to readily releasably secure the small luggage case to the wheel and handle assembly along:

a portion of the perimeter of the first face of the small luggage case; and a portion of the perimeter of the first face of the wheel and handle assembly such that:

the first face of the small luggage case abuts the first face of the wheel and handle assembly;

the top of the small luggage case is adjacent to the top of the wheel and handle assembly;

the bottom of the small luggage case is adjacent to the bottom of the wheel and handle assembly;

the first side of the small luggage case is adjacent to the first side of the wheel and handle assembly; and the second side of the small luggage case is adjacent to the second side of the wheel and handle assembly.

* * * * *